US006126574A

United States Patent [19]

Stearns et al.

[11] Patent Number: 6,126,574

[45] **Date of Patent: *Oct. 3, 2000**

[54] EXERCISE METHOD AND APPARATUS

[76] Inventors: Kenneth W. Stearns, P.O. Box 55912, Houston, Tex. 77055; Joseph D. Maresh, P.O. Box 645, West Linn, Oreg. 97068-0645

[ * ] Notice: This patent is subject to a terminal disclaimer.

[21] Appl. No.: 09/066,143

[22] Filed: Apr. 24, 1998

Related U.S. Application Data

[63] Continuation-in-part of application No. 08/839,991, Apr. 24, 1997, Pat. No. 5,803,871

[60] Provisional application No. 60/044,955, Apr. 26, 1997, provisional application No. 60/044,026, May 5, 1997, provisional application No. 60/044,960, Apr. 26, 1997, provisional application No. 60/044,961, Apr. 26, 1997, and provisional application No. 60/044,962, Apr. 26, 1997.

[51] Int. Cl.[7] ..... A63B 22/00

[52] U.S. Cl. ..... 482/52; 482/57

[58] Field of Search ..... 482/51, 52, 53, 482/57, 70, 79, 80, 60, 62, 148

[56] References Cited

U.S. PATENT DOCUMENTS

| | | | |
|---|---|---|---|
| 4,185,622 | 1/1980 | Swenson | 128/25 B |
| 4,786,050 | 11/1988 | Geschwender | 272/73 |
| 5,186,697 | 2/1993 | Rennex | 482/52 |
| 5,242,343 | 9/1993 | Miller | 482/57 |
| 5,279,529 | 1/1994 | Eschenbach | 482/57 |
| 5,401,226 | 3/1995 | Stearns | 482/70 |
| 5,423,729 | 6/1995 | Eschenbach | 482/70 |
| 5,499,956 | 3/1996 | Habing | 482/52 |
| 5,518,473 | 5/1996 | Miller | 482/57 |
| 5,529,554 | 6/1996 | Eschenbach | 482/57 |
| 5,529,555 | 6/1996 | Rodgers, Jr. | 482/57 |
| 5,562,574 | 10/1996 | Miller | 482/51 |
| 5,595,553 | 1/1997 | Rodgers, Jr. | 482/51 |
| 5,759,136 | 6/1998 | Chen | 482/70 |
| 5,792,029 | 8/1998 | Gordon | 482/70 |
| 5,803,871 | 9/1998 | Stearns et al. | 482/52 |
| 5,848,954 | 12/1998 | Stearns et al. | 482/70 |
| 5,879,271 | 3/1999 | Stearns et al. | 482/70 |

*Primary Examiner*—Stephen R. Crow

[57] ABSTRACT

An exercise apparatus includes a linkage assembly interconnected between a frame and a crank rotatably mounted on the frame. The linkage assembly includes a rail that is supported by the crank and the frame, and a foot skate that moves up and down together with the rail and back and forth relative to the rail.

20 Claims, 18 Drawing Sheets

EXERCISE METHOD AND APPARATUS

CROSS-REFERENCE TO RELATED APPLICATIONS

This application is a continuation-in-part of U.S. patent application Ser. No. 08/839,991, now U.S. Pat. No. 5,803,871 which was filed on Apr. 24, 1997; and also discloses subject matter entitled to the earlier filing date of Provisional Application Ser. Nos. 60/044,955, 60/044,960, 60/044,961, 60/044,962, all of which were filed on Apr. 26, 1997, and Provisional Application Ser. No. 60/044,026, filed on May 5, 1997.

FIELD OF THE INVENTION

The present invention relates to exercise methods and apparatus and more particularly, to exercise equipment which facilitates exercise through a curved path of motion.

BACKGROUND OF THE INVENTION

Exercise equipment has been designed to facilitate a variety of exercise motions. For example, treadmills allow a person to walk or run in place; stepper machines allow a person to climb in place; bicycle machines allow a person to pedal in place; and other machines allow a person to skate and/or stride in place. Yet another type of exercise equipment has been designed to facilitate relatively more complicated exercise motions and/or to better simulate real life activity. Such equipment typically uses some sort of linkage assembly to convert a relatively simple motion, such as circular, into a relatively more complex motion, such as elliptical. Exercise equipment has also been designed to facilitate full body exercise. For example, reciprocating cables or pivoting arm poles have been used on many of the equipment types discussed in the preceding paragraph.

SUMMARY OF THE INVENTION

The present invention may be seen to provide novel linkage assemblies and methods suitable for linking circular motion of a crank to relatively more complex, generally elliptical motion of a foot support on an exercise machine. The crank is rotatably mounted on a frame, and the linkage assembly is interconnected between the crank and the frame. The linkage assembly includes a rail having a first end supported by the crank and a second end supported by the frame. The foot support is movably mounted on the rail and connected to the crank in such a manner that rotation of the crank causes the foot support to move vertically together with the rail and horizontally relative to the rail.

In another respect, the present invention may be seen to provide novel linkage assemblies and methods suitable for linking reciprocal motion of a handle to relatively more complex, generally elliptical motion of the foot support. In particular, a handle is pivotally connected to the frame and connected to the foot support by an intermediate link. As the foot support moves through its generally elliptical path, the handle member is constrained to pivot back and forth relative to the frame.

In yet another respect, the present invention may be seen to provide novel linkage assemblies and methods suitable for adjusting the angle of the generally elliptical path of motion relative to a horizontal surface on which the exercise machine rests. In particular, the rail may be pivotally mounted to a first frame member which is selectively locked in any of a plurality of positions relative to a second frame member. An increase in the elevation of the first frame member and thus, the height of the rail's pivot axis, results in a relatively more strenuous, "uphill" exercise motion.

In still another respect, the present invention may be seen to provide novel linkage assemblies and methods suitable for adjusting the stride length of the generally elliptical path of motion. In particular, the linkage assembly components may be adjusted relative to one another to alter the effect on the foot support. Many of the advantages of the present invention may become apparent from the more detailed description that follows.

BRIEF DESCRIPTION OF THE DRAWING

With reference to the Figures of the Drawing, wherein like numerals represent like parts and assemblies throughout the several views.

DETAILED DESCRIPTION OF THE PREFERRED EMBODIMENT

Figure 1:
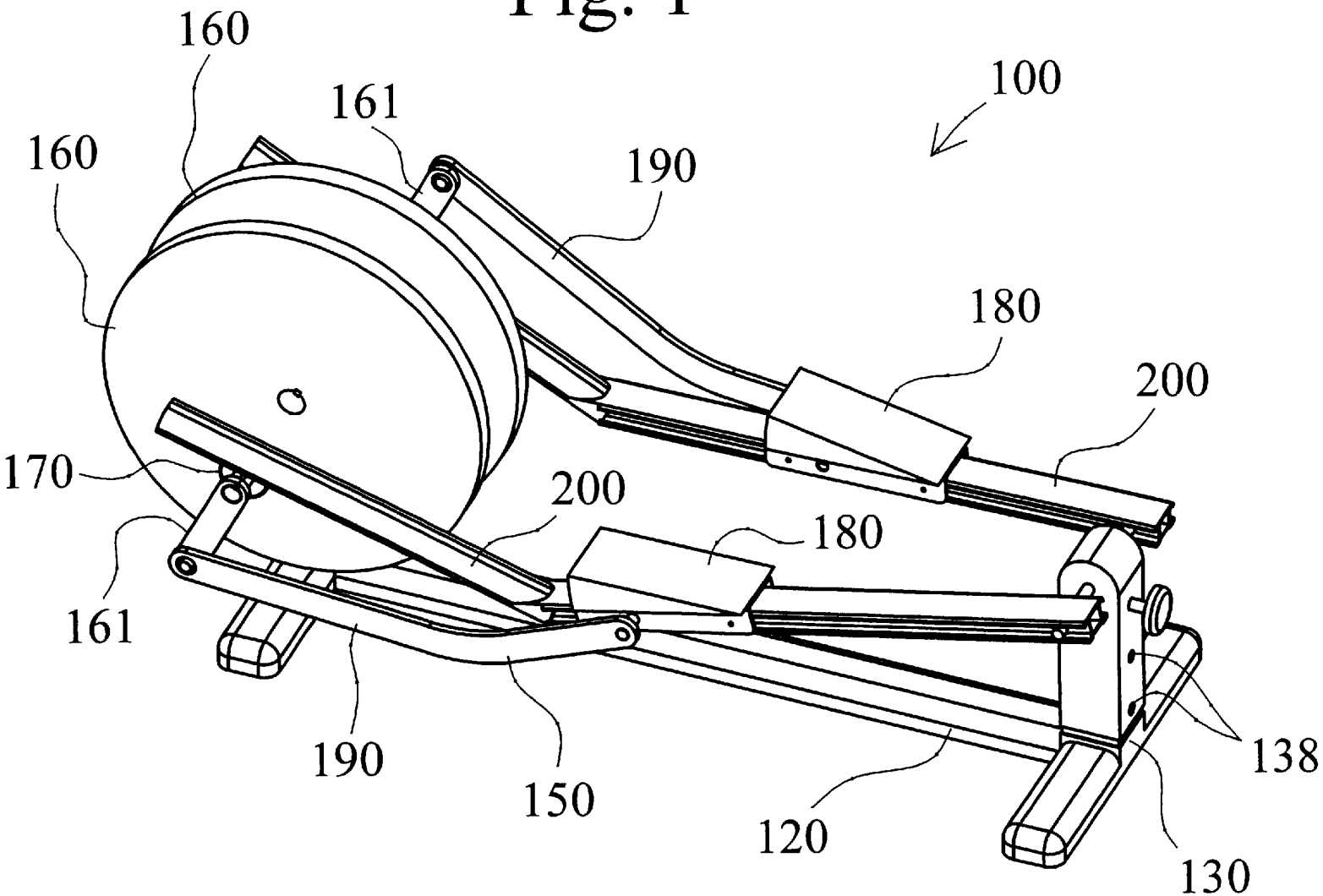
FIG. 1 is a perspective view of an exercise apparatus constructed according to the principles of the present invention.
Figure 2:
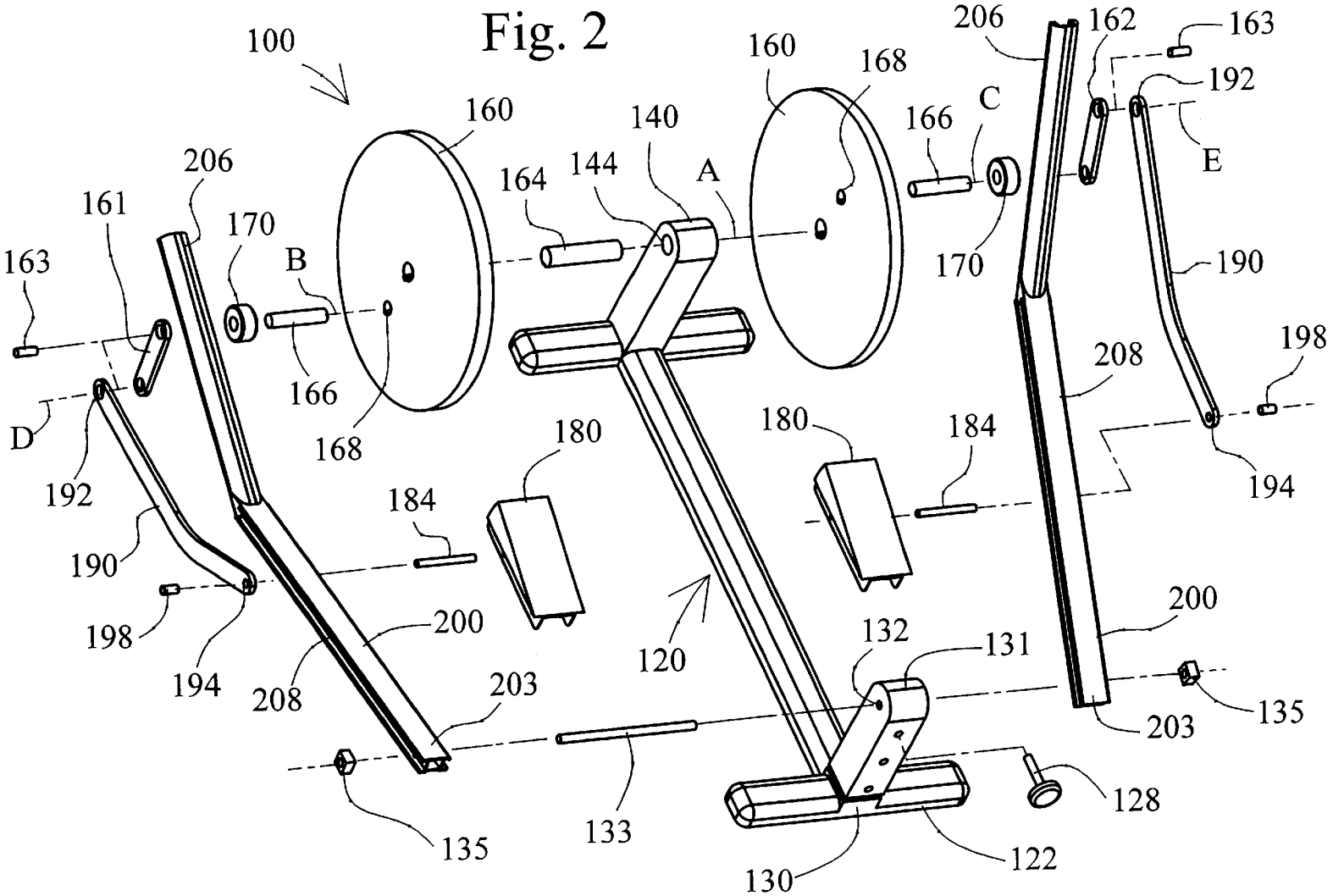
FIG. 2 is an exploded perspective view of the exercise apparatus of FIG. 1.
Figure 3:
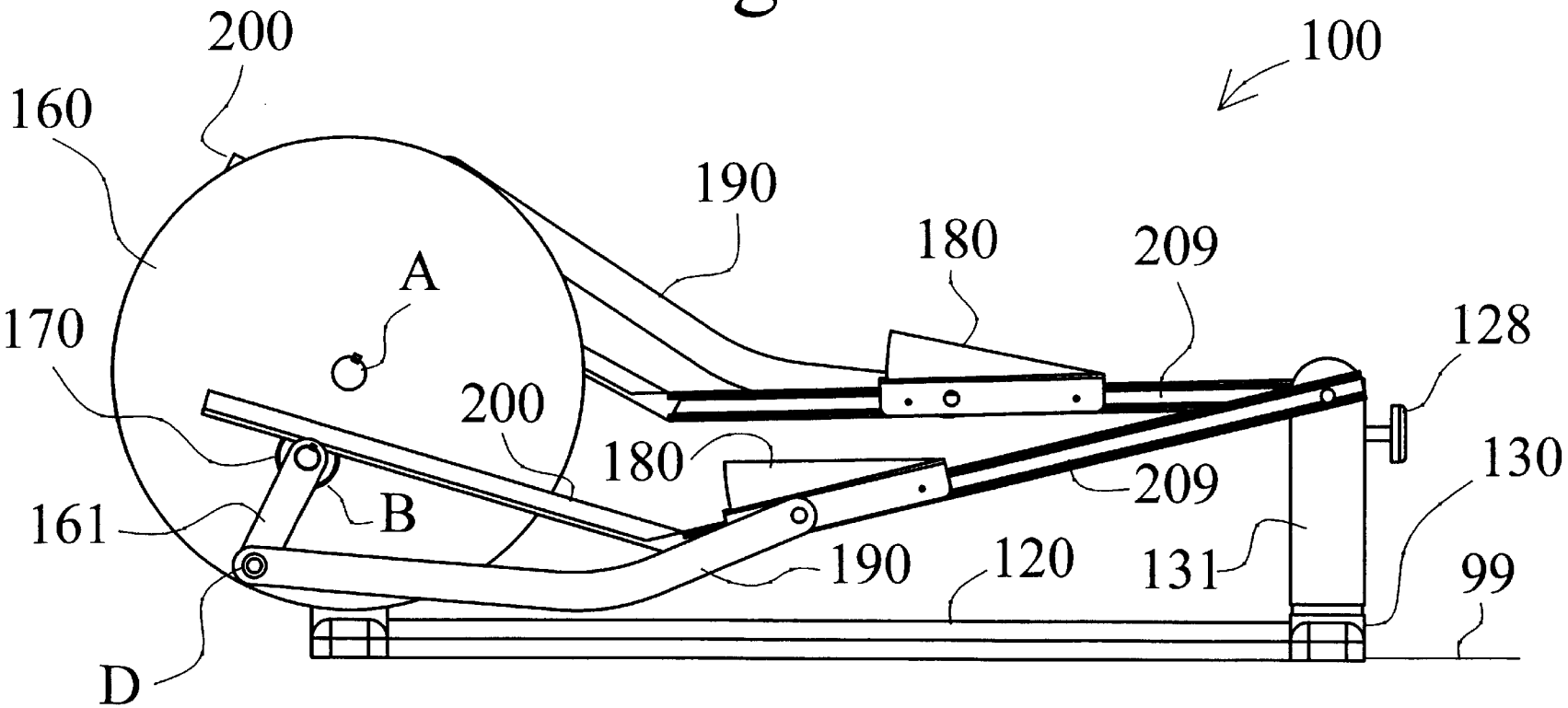
FIG. 3 is a side view of the exercise apparatus of FIG. 1.
Figure 4:
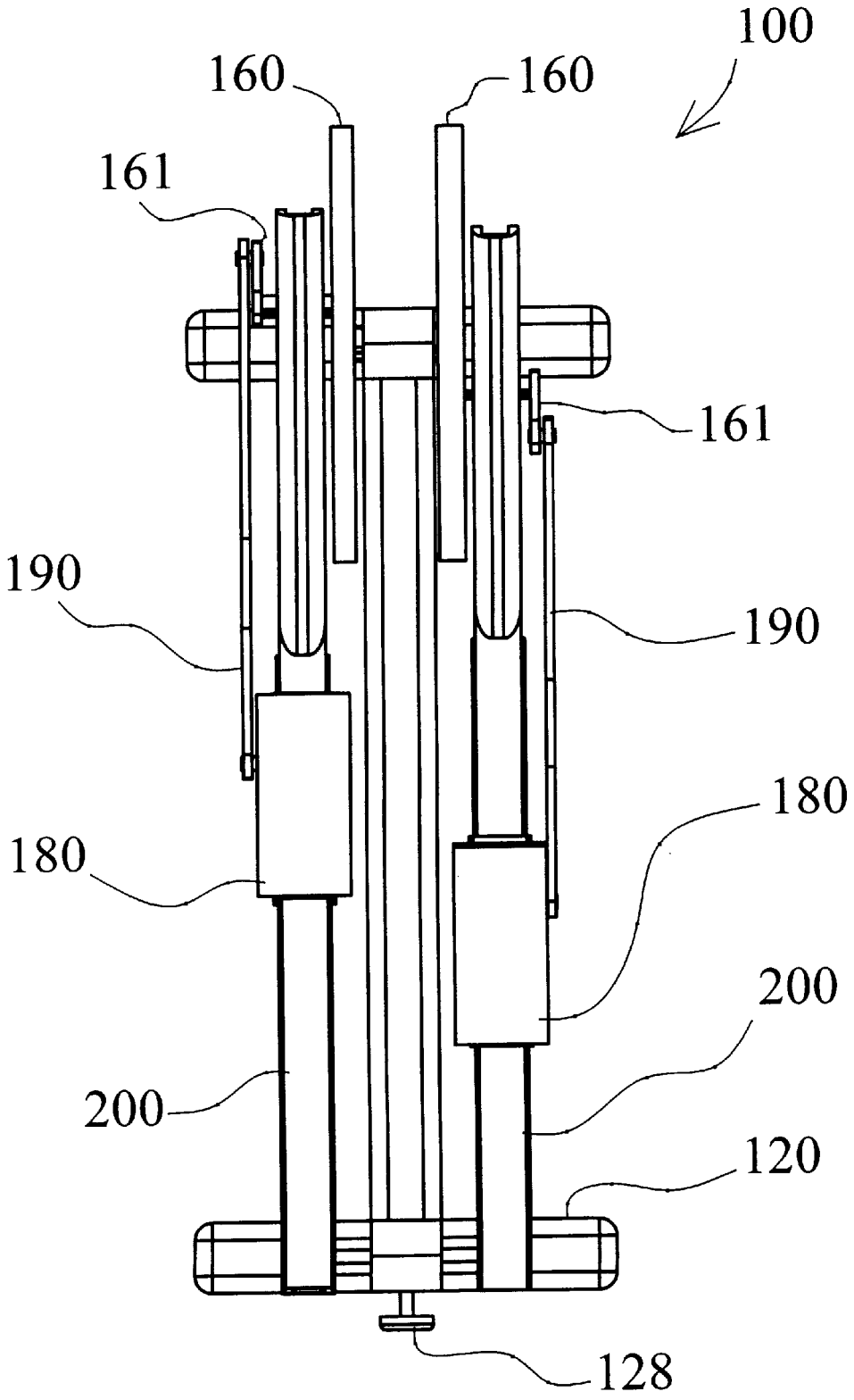
FIG. 4 is a top view of the exercise apparatus of FIG. 1.
Figure 5:
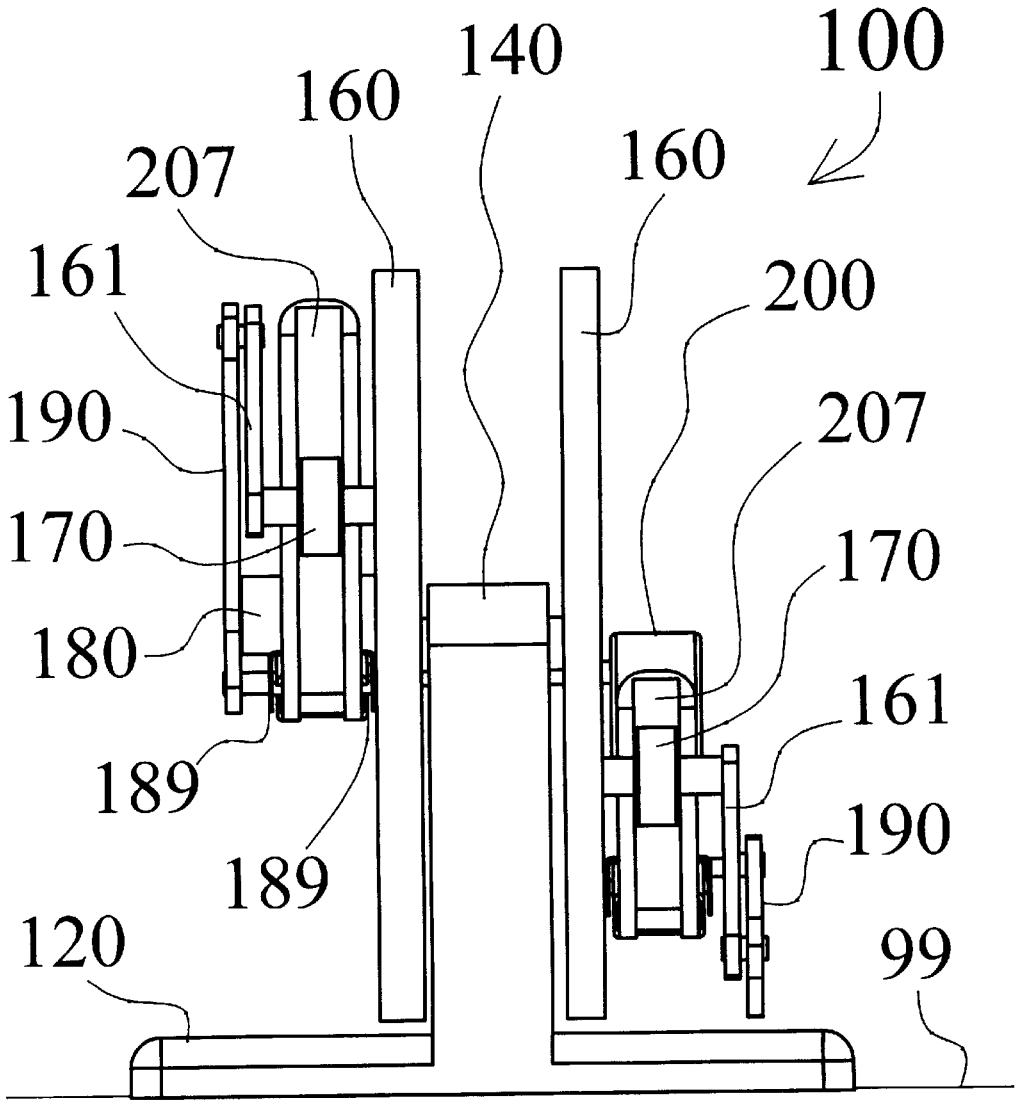
FIG. 5 is a rear view of the exercise apparatus of FIG. 1.
Figure 6A:
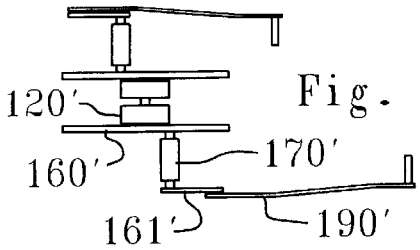
FIG. 6A is a top view of part of the linkage assembly on the exercise apparatus of FIG. 1.
Figure 6B:
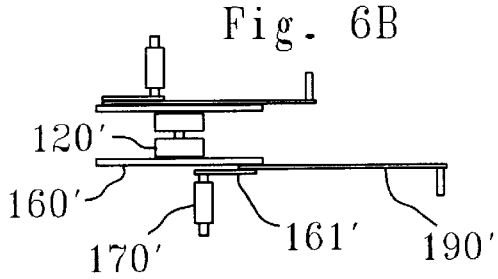
FIG. 6B is a top view of a linkage assembly similar to that of FIG. 6A, showing a second, discrete arrangement of the linkage assembly components.
Figure 6C:
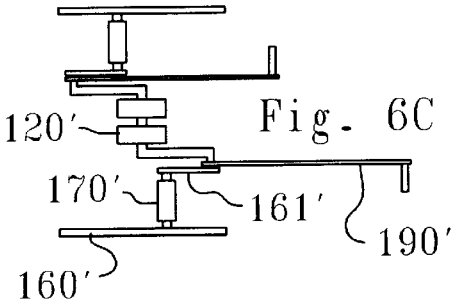
FIG. 6C is a top view of a linkage assembly similar to that of FIG. 6A, showing a third, discrete arrangement of the linkage assembly components.
Figure 6D:
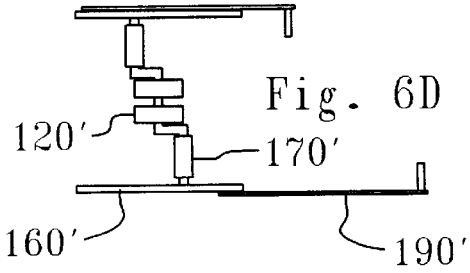
FIG. 6D is a top view of a linkage assembly similar to that of FIG. 6A, showing a fourth, discrete arrangement of the linkage assembly components.
Figure 6E:
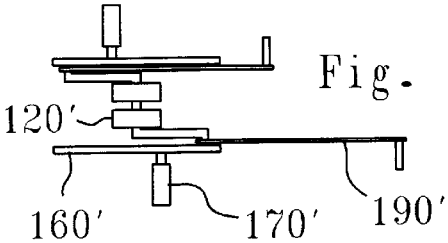
FIG. 6E is a top view of a linkage assembly similar to that of FIG. 6A, showing a fifth, discrete arrangement of the linkage assembly components.
Figure 6F:
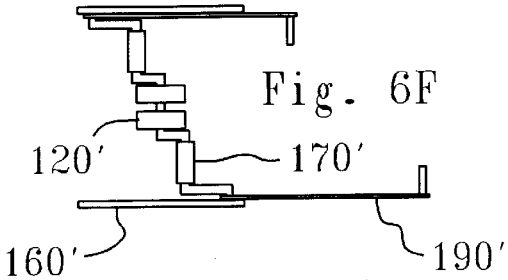
FIG. 6F is a top view of a linkage assembly similar to that of FIG. 6A, showing a sixth, discrete arrangement of the linkage assembly components.
Figure 6G:
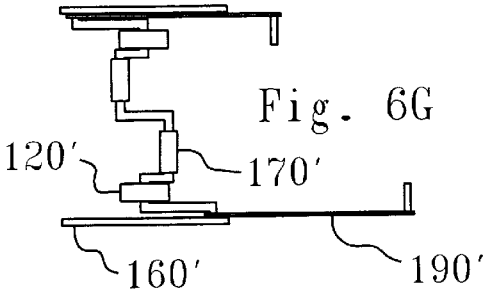
FIG. 6G is a top view of a linkage assembly similar to that of FIG. 6A, showing a seventh, discrete arrangement of the linkage assembly components.
Figure 6H:
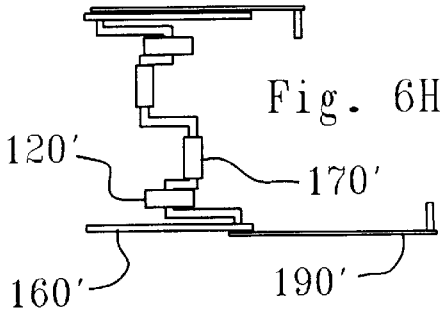
FIG. 6H is a top view of a linkage assembly similar to that of FIG. 6A, showing an eighth, discrete arrangement of the linkage assembly components.
Figure 6I:
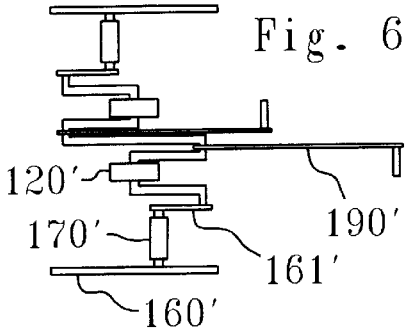
FIG. 6I is a top view of a linkage assembly similar to that of FIG. 6A, showing a ninth, discrete arrangement of the linkage assembly components.
Figure 6J:
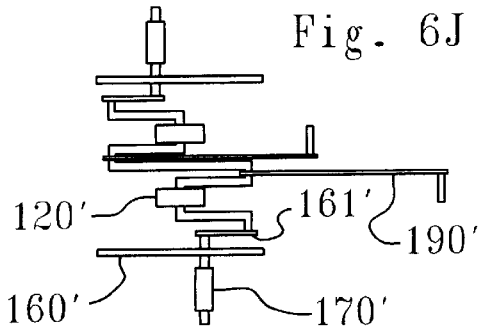
FIG. 6J is a top view of a linkage assembly similar to that of FIG. 6A, showing a tenth, discrete arrangement of the linkage assembly components.

A first embodiment exercise apparatus constructed according to the principles of the present invention is designated as 100 in FIGS. 1–5. The apparatus 100 generally includes a frame 120 and a linkage assembly 150 movably mounted on the frame 120. Generally speaking, the linkage assembly 150 moves relative to the frame 120 in a manner that links rotation of a flywheel 160 to generally elliptical motion of a force receiving member 180. The term "elliptical motion" is intended in a broad sense to describe a closed path of motion having a relatively longer first axis and a relatively shorter second axis (which extends perpendicular to the first axis).

The frame 120 includes a base 122, a forward stanchion 130, and a rearward stanchion 140. The base 122 may be described as generally I-shaped and is designed to rest upon a generally horizontal floor surface 99 (see FIGS. 3 and 5). The apparatus 100 is generally symmetrical about a vertical plane extending lengthwise through the base 122 (perpendicular to the transverse ends thereof), the only exception being the relative orientation of certain parts of the linkage assembly 150 on opposite sides of the plane of symmetry. On the embodiment 100, the "right-hand" components are one hundred and eighty degrees out of phase relative to the "left-hand" components. However, like reference numerals are used to designate both the "right-hand" and "left-hand" parts on the apparatus 100, and when reference is made to one or more parts on only one side of the apparatus, it is to be understood that corresponding part(s) are disposed on the opposite side of the apparatus 100. Those skilled in the art will also recognize that the portions of the frame 120 which are intersected by the plane of symmetry exist individually and thus, do not have any "opposite side" counterparts. Furthermore, to the extent that reference is made to forward or rearward portions of the apparatus 100, it is to be understood that a person could exercise on the apparatus 100 while facing in either direction relative to the linkage assembly 150.

The forward stanchion 130 extends perpendicularly upward from the base 122 and supports a telescoping tube 131. A plurality of holes 138 are formed in the tube 131, and a single hole is formed in the upper end of the stanchion 130 to selectively align with any one of the holes 138. A pin 128, having a ball detent, may be inserted through an aligned set of holes to secure the tube 131 in a raised position relative to the stanchion 130. A laterally extending hole 132 is formed through the tube 131.

The rearward stanchion 140 extends perpendicularly upward from the base 122 and supports a bearing assembly. An axle 164 is inserted through a laterally extending hole 144 in the bearing assembly to support a pair of flywheels 160 in a manner known in the art. For example, the axle 164 may be inserted through the hole 144, and then a flywheel 160 may be keyed to each of the protruding ends of the axle 164, on opposite sides of the stanchion 140. Those skilled in the art will recognize that the flywheels 160 could be replaced by some other rotating member(s) which may or may not, in turn, be connected to one or more flywheels. These rotating members 160 rotate about an axis designated as A.

A radially displaced shaft 166 is rigidly secured to each flywheel 160 by means known in the art. For example, the shaft 166 may be inserted into a hole 168 in the flywheel 160 and welded in place. The shaft 166 is secured to the flywheel 160 at a point radially displaced from the axis A, and thus, the shaft 166 rotates at a fixed radius about the axis A. In other words, the shaft 166 and the flywheel 160 cooperate to define a first crank having a first crank radius.

A roller 170 is rotatably mounted on each shaft 166. The roller 170 on the right side of the apparatus 100 rotates about an axis B, and the roller 170 on the left side of the apparatus 100 rotates about an axis C. A rigid member or crank arm 161 is fixedly secured to each shaft 166 by means known in the art. For example, the shaft 166 may be inserted into a hole in the rigid member 161 and then keyed in place. The roller 170 is retained on the shaft 164 between the flywheel 160 and the rigid member 161.

Each rigid member 161 extends from the shaft 166 to a distal end 162 which occupies a position radially displaced from the axis A and rotates at a fixed radius about the axis A. In other words, the distal end 162 and the flywheel 160, together with the parts interconnected therebetween, cooperate to define a second crank having a second, relatively greater crank radius. On the embodiment 100, the second crank and the first crank are portions of a single unitary member and share a common rotational axis A.

A link 190 has a rearward end 192 rotatably connected to the distal end 162 of the member 161 by means known in the art. For example, holes may be formed through distal end 162 and the rearward end 192, and a rivet-like fastener 163 may inserted through the holes and secured therebetween. As a result of this arrangement, the link 190 on one side of the apparatus 100 rotates about an axis D relative to a respective distal end 162 and flywheel 160; and the link 190 on the other side of the apparatus 100 rotates about an axis E relative to a respective distal end 162 and flywheel 160. On the embodiment 100, the axes A, B, and D may be said to be radially aligned, and the axes A, C, and E may be said to be radially aligned. Also, the axes B and D may be said to be diametrically opposed from the axes C and E.

Each link 190 has a forward end 194 rotatably connected to a respective force receiving member 180 by means known in the art. For example, a pin 184 may be secured to the force receiving member 180, and a hole may be formed through the forward end 194 of the link 190 to receive the pin 184. A nut 198 may then be threaded onto the distal end of the pin 184. As a result of this arrangement, the link 190 may be said to be rotatably interconnected between the flywheel 160 and the force receiving member 180, and/or to provide a discrete means for interconnecting the flywheel 160 and the force receiving member 180.

Each force receiving member 180 is rollably mounted on a respective rail or track 200 and thus, may be described as a skate or truck. Each force receiving member 180 provides an upwardly facing support surface 188 sized and configured to support a person's foot.

Each rail 200 has a forward end 203, a rearward end 206, and an intermediate portion 208. The forward end 203 of each rail 200 is movably connected to the frame 120, forward of the flywheels 160. In particular, each forward end 203 is rotatably connected to the forward stanchion 130 by means known in the art. For example, a shaft 133 may be inserted into the hole 132 through the tube 131 and into holes through the forward ends 203 of the rails 200. The shaft 133 may be keyed in place relative to the stanchion 130, and nuts 135 may be secured to opposite ends of the shaft 133 to retain the forward ends 203 on the shaft 133. As a result of this arrangement, the rail 200 may be said to provide a discrete means for movably interconnecting the force receiving member 180 and the frame 120.

The rearward end 206 of the rail 200 is supported or carried by the roller 170. In particular, the rearward end 206 may be generally described as having an inverted U-shaped profile into which an upper portion of the roller 170 protrudes. The "base" of the inverted U-shaped profile is defined by a flat bearing surface 207 which bears against or rides on the cylindrical surface of the roller 170. Those skilled in the art will recognize that other structures (e.g. studs) could be substituted for the rollers 170. In any case, the rail 200 may be said to provide a discrete means for movably interconnecting the flywheel 160 and the force receiving member 180.

The intermediate portion 208 of the rail 200 may be defined as that portion of the rail 200 along which the skate 180 may travel and/or as that portion of the rail 200 between the rearward end 206 (which rolls over the roller 170) and the forward end 203 (which is rotatably mounted to the frame 120). The intermediate portion 208 may be generally described as having an I-shaped profile or as having a pair of C-shaped channels which open away from one another. Each channel 209 functions as a race or guide for one or more rollers 189 rotatably mounted on each side of the foot skate 180. Those skilled in the art will recognize that other structures (e.g. bearings) could be substituted for the rollers 189.

On the embodiment 100, both the end portion 206 and the intermediate portion 208 of the support member 200 are linear. However, either or both may be configured as a curve without departing from the scope of the present invention. Moreover, although the end portion 206 is fixed relative to the intermediate portion 208, an orientation adjustment could be provided on an alternative embodiment, as well.

Those skilled in the art will also recognize that each of the components of the linkage assembly 150 is necessarily long enough to facilitate the depicted interconnections. For example, the members 161 and the links 190 must be long enough to interconnect the flywheel 160 and the force receiving member 180 and accommodate a particular crank radius. Furthermore, for ease of reference in both this detailed description and the claims set forth below, the components are sometimes described with reference to "ends" being connected to other parts. For example, the link 190 may be said to have a first end rotatably connected to the member 161 and a second end rotatably connected to the force receiving member 180. However, those skilled in the art will recognize that the present invention is not limited to links which terminate immediately beyond their points of connection with other parts. In other words, the term "end" should be interpreted broadly, in a manner that could include "rearward portion", for example; and in a manner wherein "rear end" could simply mean "behind an intermediate portion", for example.

Those skilled in the art will further recognize that the above-described components of the linkage assembly 150 may be arranged in a variety of ways. For example, in each of FIGS. 6A–6J, flywheels 160', support rollers 170', members 161', and links 190' are shown in several alternative configurations relative to one another and the frame 120' (in some embodiments, there is no need for a discrete part 161' because both the links 190' and the rollers 170' are connected directly to the flywheels 160').

In operation, rotation of the flywheel 160 causes the shaft 166 to revolve about the axis A, thereby pivoting the rail 200 up and down relative to the frame 120, through a range of motion equal to twice the radial distance between the axis A and either axis B or C. Rotation of the flywheel 160 also causes the distal end 162 of the member 161 to revolve about the axis A, thereby moving the force receiving member 180 back and forth along the rail 200, through a range of motion equal to twice the radial distance between the axis A and either axis D or E. In other words, the present invention provides an apparatus and a method for moving a force receiving member through a path having a horizontal component which is not necessarily related to or limited by the vertical component. As a result, it is a relatively simple matter to design an apparatus with a desired "aspect ratio" for the elliptical path to be traveled by the foot platform. For example, movement of the axes D and E farther from the axis A and/or movement of the axes B and C closer to the axis A will result in a relatively flatter path of motion. Ultimately, the exact size, configuration, and arrangement of the components of the linkage assembly 150 are a matter of design choice.

Figure 7:
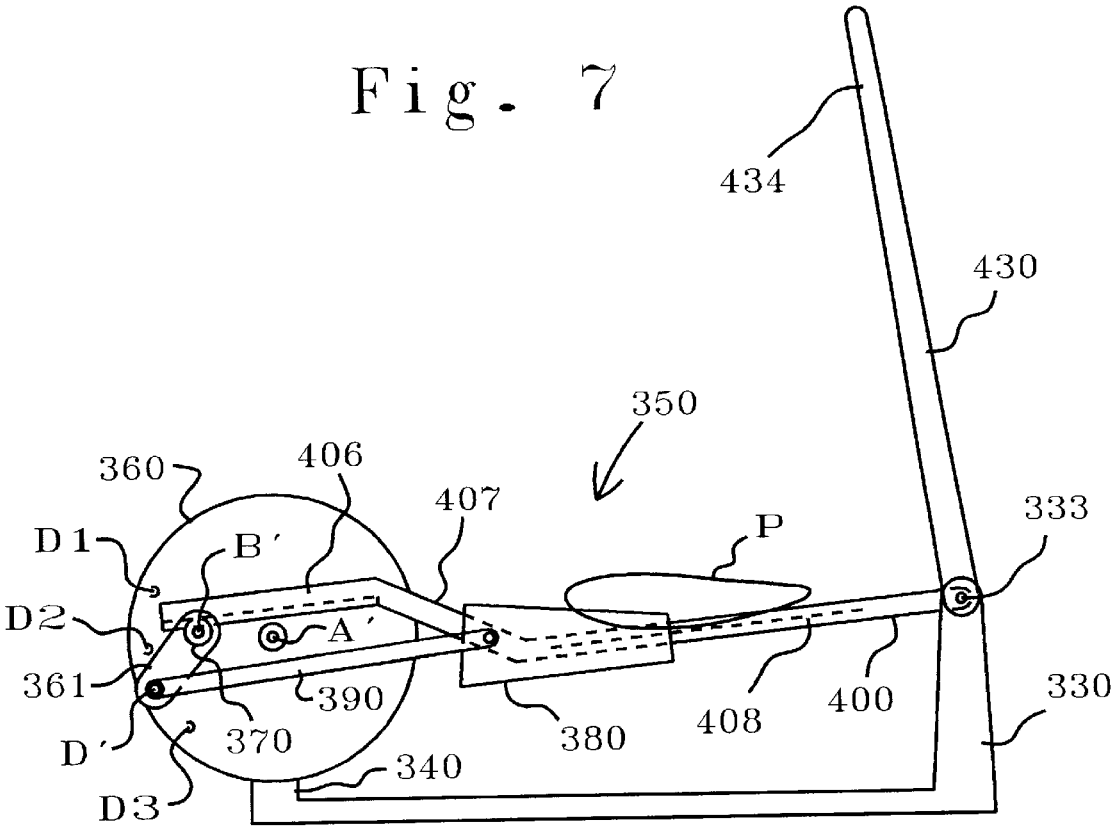
FIG. 7 is a side view of an alternative embodiment exercise apparatus constructed according to the principles of the present invention.

Recognizing that the spatial relationships, including the radii and angular displacement of the crank axes, may vary for different sizes, configurations, and arrangements of the linkage assembly components, another embodiment of the present invention is shown in FIG. 7 and designated as 300. The exercise apparatus 300 includes a linkage assembly 350 movably mounted on a frame 320, and a handle member 430 movably mounted on the frame 320, as well.

Like on the embodiment 100, a flywheel 360 is rotatably connected to a rearward stanchion 340 on the frame 320 and rotates about an axis A'; and a roller 370 is rotatably connected to the flywheel 360 and rotates about an axis B', which is radially offset from the axis A'. A rigid member 361 extends from a first end connected to the flywheel 360, proximate axis B', to a second end which is radially offset and circumferentially displaced from the axis B'. A link 390 has a rearward end rotatably connected to the distal end of the member 361. The link 390 rotates about an axis D' relative to the member 361. Simply by varying the size, configuration, and/or orientation of the member 361 and/or the link 390, any of various rotational link axes (D1–D3, for example) may be provided in place of the axis D.

An opposite, forward end of the link 390 is rotatably connected to a force receiving member 380 that rolls along an intermediate portion 408 of a rail 400. A rearward end 406 of the rail 400 is supported on the roller 370. On this embodiment 300, a discrete segment 407 separates or offsets the rearward end 406 and the intermediate portion 408.

A forward end of the rail 400 is pivotally connected to a forward stanchion 330 on the frame 320 by means of a shaft 333. The handle member 430 is also pivotally connected to the forward stanchion 330 by means of the same shaft 333. As a result, the handle member 430 and the rail 400 independently pivot about a common pivot axis. The handle member 430 includes an upper, distal portion 434 which is sized and configured for grasping by a person standing on the force receiving member 380. In operation, the alternative embodiment 300 allows a person to selectively perform arm exercise, by pivoting the handle 430 back and forth, while also performing leg exercise, by driving the force receiving member 380 through the path of motion P (as traced with reference to the approximate center of the foot supporting surface).

Figure 8:
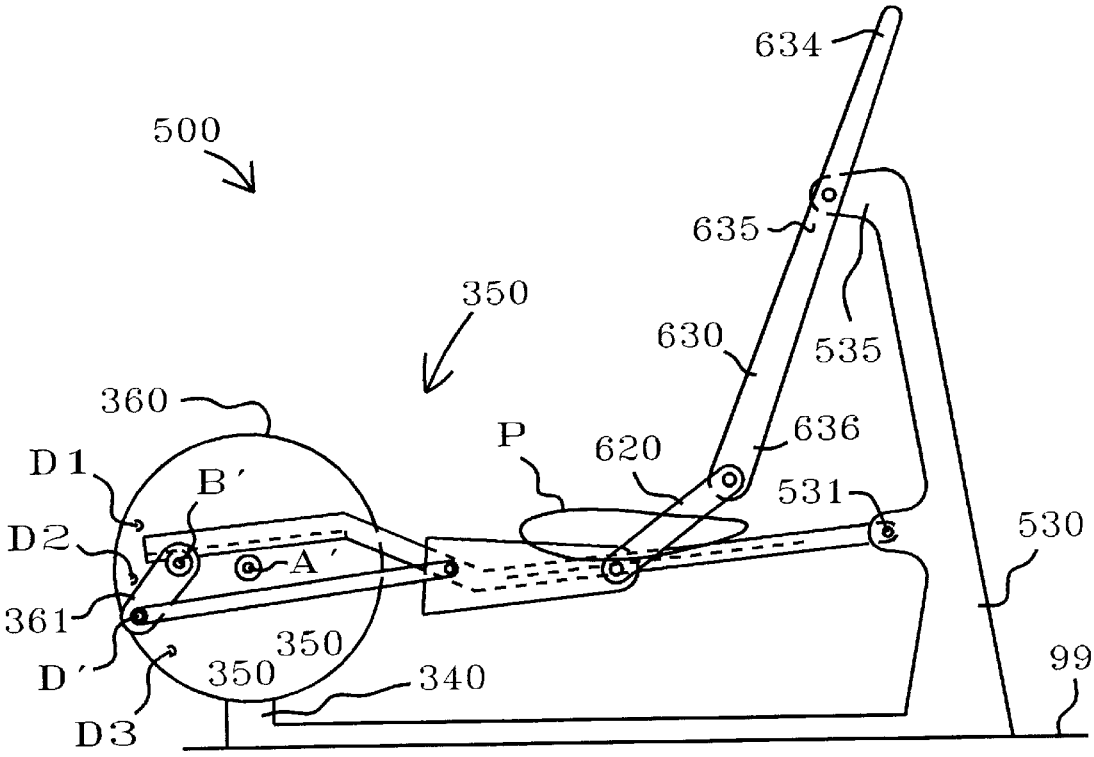
FIG. 8 is a side view of another alternative embodiment exercise apparatus constructed according to the principles of the present invention.

Yet another alternative embodiment of the present invention is designated as 500 in FIG. 8. The exercise apparatus 500 includes a linkage assembly 350 (identical to that of the alternative embodiment 300) movably mounted on a frame 520 and linked to a handle member 630, which is also movably mounted on the frame 520.

A forward end of the rail 400 is pivotally connected to a first trunnion 531 on a forward stanchion 530, at a first elevation above a floor surface 99. A handle member 630 has an intermediate portion 635 which is pivotally connected to a second trunnion 535 on the forward stanchion 530, at a second, relatively greater elevation above the floor surface 99. An upper, distal portion 634 of the handle member 630 is sized and configured for grasping by a person standing on the force receiving member 380. A lower, distal portion 636 of the handle member 630 is rotatably connected to one end of a handle link 620. An opposite end of the handle link 620 is rotatably connected to the force receiving member 380. In operation, the handle link 620 links back and forth pivoting of the handle 430 to movement of the force receiving member 380 through the path of motion P.

Figure 9:
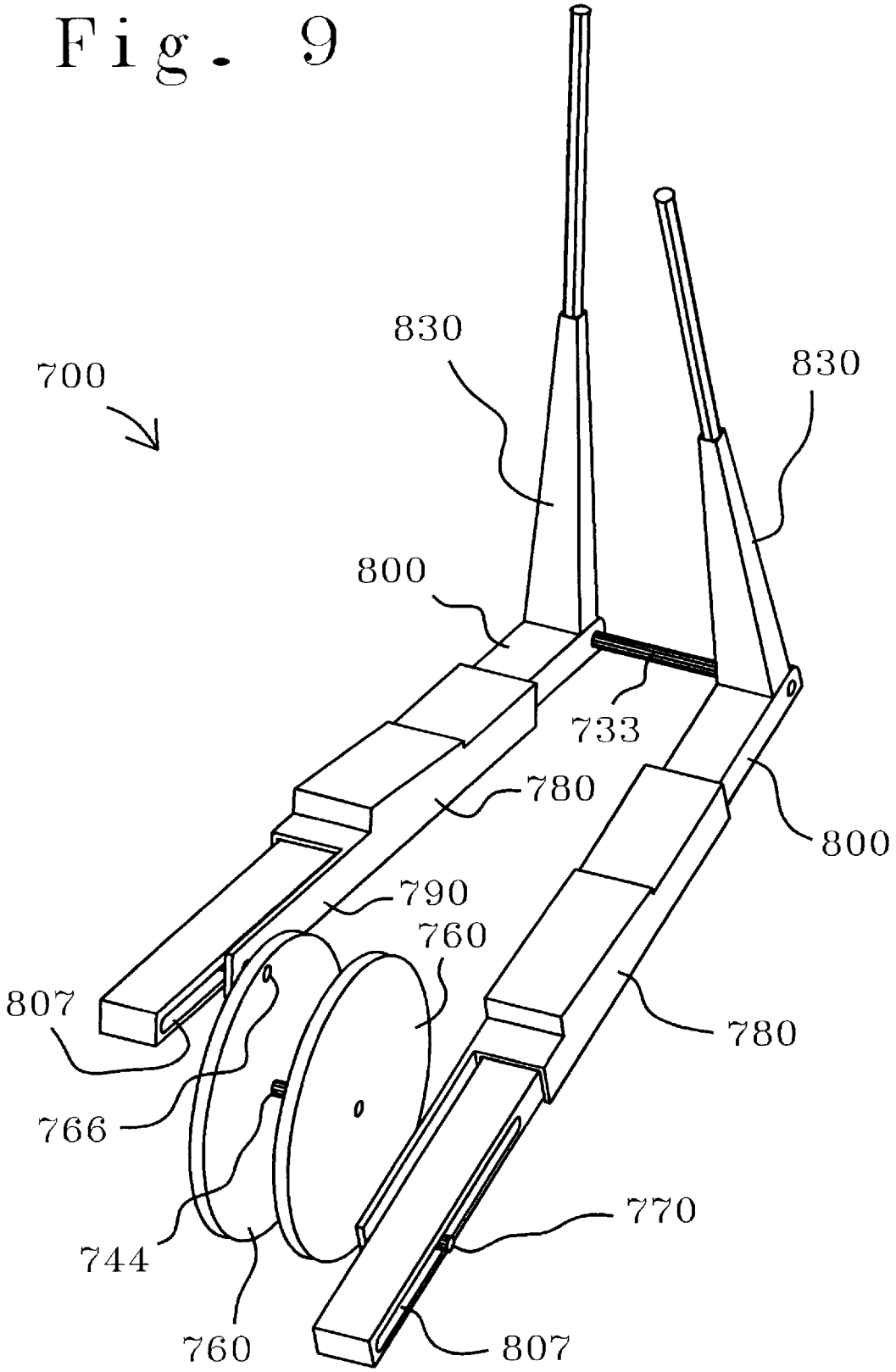
FIG. 9 is a perspective view of yet another alternative embodiment exercise apparatus constructed according to the principles of the present invention.

An alternative embodiment linkage assembly, constructed according to the principles of the present invention, is designated as 700 in FIG. 9. The assembly 700 is movably connected to a frame (not shown) by means of a forward shaft 733 and a rearward shaft 744. Flywheels 760 are rotatably mounted on the shaft 744 and rotate relative to the frame. A rigid shaft 766 extends axially outward from a radially displaced point on each flywheel 760. Each shaft 766 extends through a hole in a link 790, and a roller 770 is rotatably mounted on the distal end of each shaft 766. Each roller 770 is disposed within a race or slot 807 formed in the rearward end of a support member or rail 800. The forward end of each rail 800 is pivotally mounted on the shaft 733. In response to rotation of the flywheel 760, the rail 800 rolls back and forth across the roller 770 as the latter causes the former to pivot up and down about the shaft 733. The lower wall of the slot 807 limits upward travel of the rail 800 away from the roller 770.

A handle member 830 is rigidly mounted to the forward end of each rail 800 to pivot together therewith. Alternatively, handle members could be pivotally mounted on the shaft 733, between the rails 800, for example, to pivot independently of the rails 800.

Each link 790 extends forward and integrally joins a respective force receiving member 780 which is rollably mounted on a respective rail 800. In response to rotation of the flywheel 760, the shaft 766 drives the link 790 and the force receiving member 780 back and forth along the rail 800.

Figure 10:
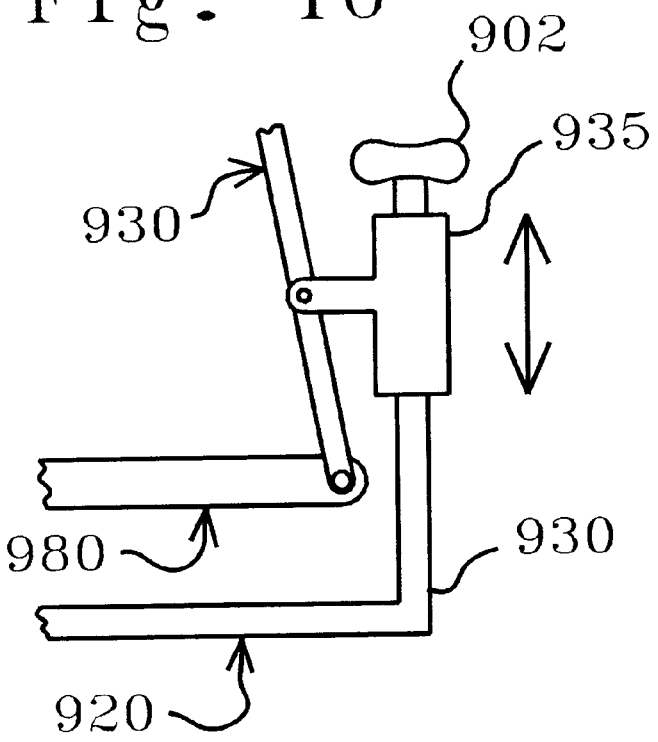
FIG. 10 is a diagrammatic side view of an elevation adjustment mechanism suitable for use on exercise apparatus constructed according to the present invention.

FIG. 10 shows an alternative height adjustment mechanism (in lieu of ball detent pins and selectively aligned holes). As with the foregoing embodiments, a frame 920 includes a support 935 movable along an upwardly extending stanchion 930, and a pivoting member 930 is rotatably interconnected between the support 935 and a force receiving member 980. A knob 902 is rigidly secured to a lead screw which extends through the support 935 and threads into the stanchion 930. The knob 902 and the support 935 are interconnected in such a manner that the knob 902 rotates relative to the support 935, but they travel up and down together relative to the stanchion 930 (as indicated by the arrows) when the knob 902 is rotated relative to the stanchion 930.

Figure 11:
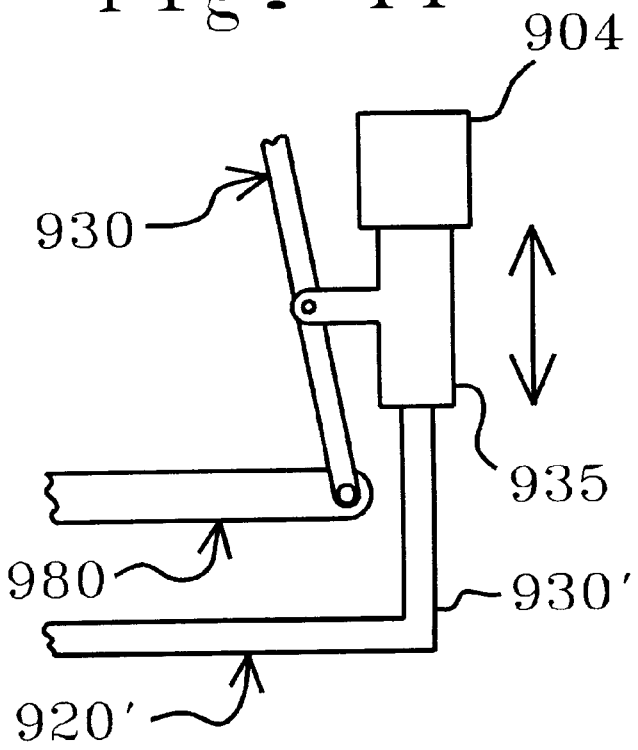
FIG. 11 is a diagrammatic side view of another elevation adjustment mechanism suitable for use on exercise apparatus constructed according to the present invention.

Yet another suitable height adjustment mechanism is shown diagrammatically in FIG. 11, wherein a frame 920' includes a support 935 movable along an upwardly extending stanchion 930', and a pivoting member 930 is rotatably interconnected between the support 935 and a force receiving member 980. A powered actuator 904, such as a motor or a hydraulic drive, is rigidly secured to the support 935 and connected to a movable shaft which extends through the support 935 and into the stanchion 930'. The actuator 904 selectively moves the shaft relative to the support 935, causing the actuator 904 and the support 935 to travel up and down together relative to the stanchion 930' (as indicated by the arrows). The actuator 904 may operate in response to signals from a person and/or a computer controller.

Figure 12:
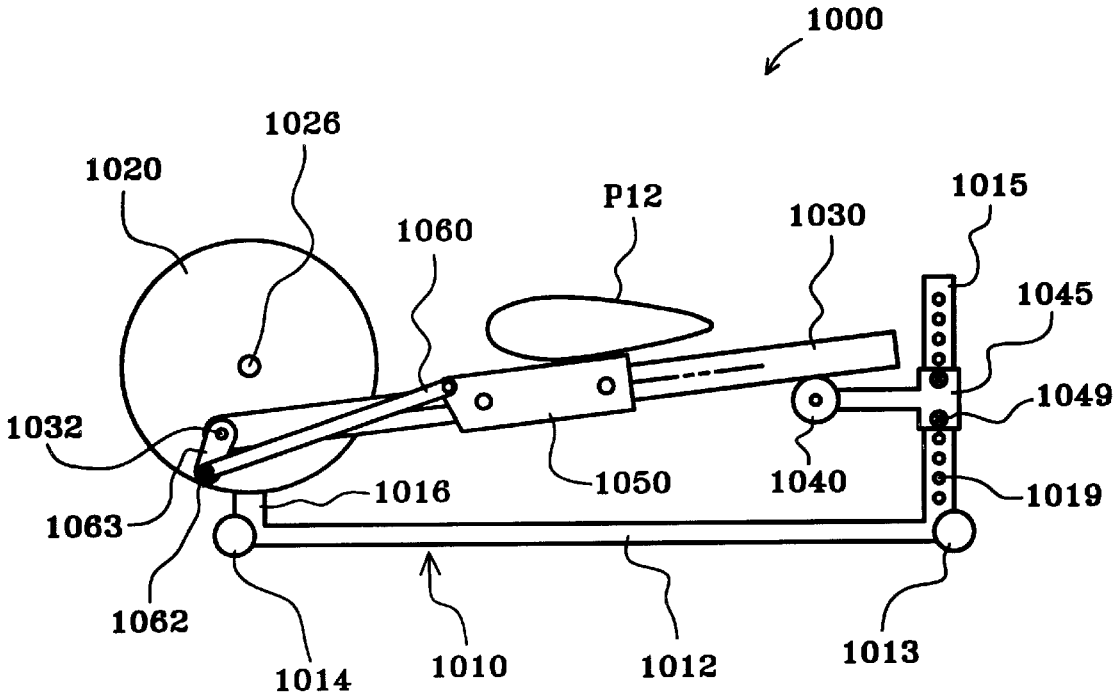
FIG. 12 is a side view of another embodiment of the present invention.

Another discrete embodiment of the present invention is designated as 1000 in FIG. 12. The apparatus 1000 has a frame 1010 which includes an I-shaped base 1012; a forward stanchion or upright 1015 which extends upward from the base 1012 proximate a first end 1013 thereof; and a rearward stanchion or upright 1016 which extends upward from the base 1012 proximate a second, opposite end 1014 thereof.

Left and right flywheels (or cranks) 1020 are rotatably mounted on opposite sides of the rearward stanchion 1016 and rotate together about a common crank axis 1026. Those skilled in the art will recognize that the flywheels 1020 may be connected to a conventional resistance device or replaced by some other rotating member(s) which may or may not, in turn, be connected to one or more flywheels and/or a conventional resistance device.

Left and right rails 1030 have rear ends which are rotatably connected to radially displaced portions of respective cranks 1020, thereby defining rotational axes 1032. The rotational axes 1032 are constrained to rotate about the crank axis 1026 and define a fixed crank diameter therebetween. The rails 1030 have forward ends which are supported by respective rollers 1040. The rollers 1040 are rotatably mounted on a common support 1045 which is connected to the stanchion 1015. The support 1045 is selectively movable along the stanchion 1015 (by means of fasteners 1049 and holes 1019) to adjust the inclination of exercise motion.

Left and right foot skates 1050 are movably mounted (by means known in the art) on intermediate portions of respective rails 1030. Each foot skate 1050 is sized and configured to support a respective foot of a standing person. Left and right drawbar links 1060 are rotatably interconnected between respective skates 1050 and respective cranks 1020. The drawbar links 1060 cooperate with the cranks 1020 to define respective rotational axes 1062 which are constrained to rotate about the crank axis 1026 at a second, relatively larger crank diameter. The rotational axes 1062 are offset from respective rotational axes 1032 by means of respective links 1063, which are rigidly secured to respective cranks 1020 at respective rotational axes 1032, and which are rotatably secured to respective drawbar links 1060 at rotational axes 1062. The links 1063 are arranged in such a manner that respective rotational axes 1062 and 1032 are approximately radially aligned with one another on this embodiment 1000.

The resulting linkage assembly links rotation of the cranks 1020 to movement of the foot skates 1050 through generally elliptical paths designated as P12 in FIG. 12. The foot skates 1050 move vertically together with their respective rails 1030 and horizontally independent of their respective rails 1030.

Figure 13:
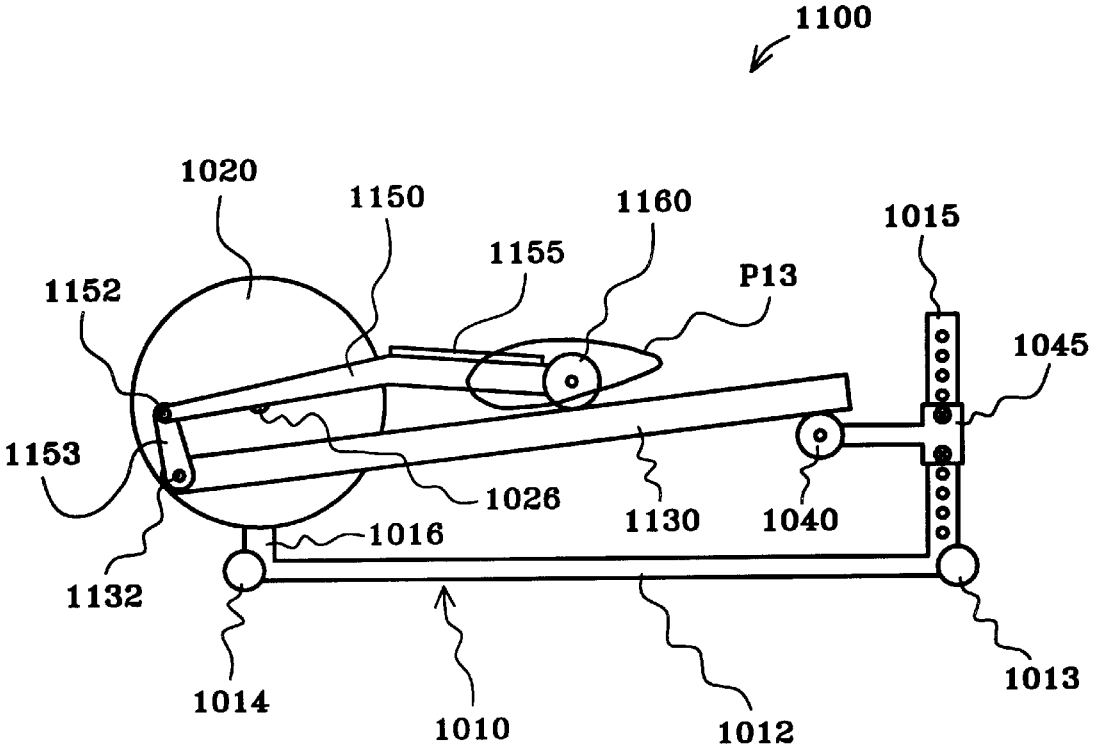
FIG. 13 is a side view of another embodiment of the present invention.

Another discrete embodiment of the present invention is designated as 1100 in FIG. 13. The apparatus 1100 has the same frame 1010 as the previous embodiment 1000, including the I-shaped base 1012; the forward stanchion or upright 1015 which extends upward from the base 1012 proximate the first end 1013 thereof; and the rearward stanchion or upright 1016 which extends upward from the base 1012 proximate the second, opposite end 1014 thereof. Also, similar left and right flywheels 1020 are rotatably mounted on opposite sides of the rearward stanchion 1016 and rotate together about the same common crank axis 1026.

Left and right rails 1130 have rear ends which are rotatably connected to radially displaced portions of respective cranks 1020. The rails 1130 cooperate with the cranks 1020 to define rotational axes 1132 which are constrained to rotate about the crank axis 1026 and which define a fixed crank diameter therebetween. The rails 1130 have forward ends which are supported by the same rollers 1040 as on the previous embodiment 1000. The rollers 1040 are rotatably mounted on a similar support 1045 which is selectively movable along the stanchion 1015 (by means of fasteners 1049 and holes 1019) to adjust the inclination of exercise motion.

Left and right foot supporting members 1150 have rear ends rotatably connected to respective cranks 1020. The foot supporting members 1150 cooperate with the cranks 1020 to define respective rotational axes 1152 which are constrained to rotate about the crank axis 1026 at a second, relatively smaller crank diameter. The rotational axes 1152 are offset from respective rotational axes 1132 by means of respective links 1153, which are rigidly secured to respective cranks 1020 at respective rotational axes 1132, and which are rotatably secured to respective foot supporting members 1150 at rotational axes 1152. The links 1153 are arranged in such a manner that the rotational axes 1152 and 1132 are not radially aligned with one another on this embodiment 1100.

An intermediate portion 1155 of each foot supporting member 1150 is sized and configured to support a respective foot of a standing person. A forward end of each foot supporting member 1150 is connected to a roller 1160 which is supported by an intermediate portion of a respective rail 1130. The resulting linkage assembly links rotation of the cranks 1020 to movement of the foot supports 1150 through generally elliptical paths designated as P13 in FIG. 13. The foot supports 1150 move vertically together with their respective rails 1130 and horizontally independent of their respective rails 1130.

Figure 14:
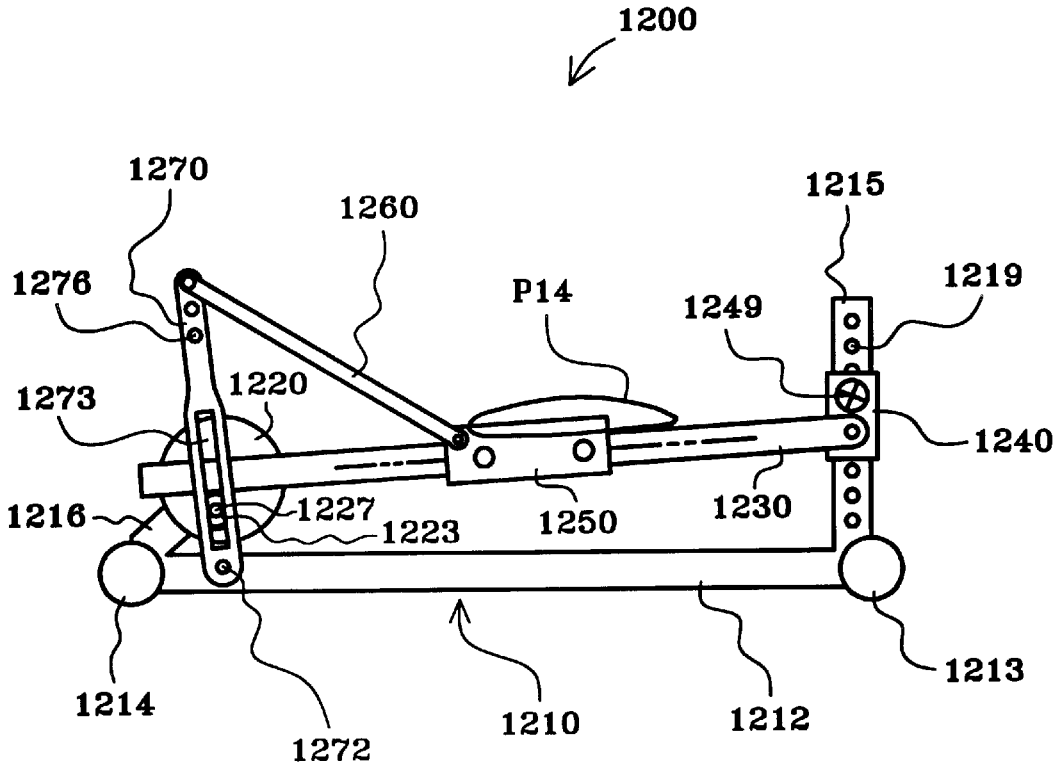
FIG. 14 is a side view of another embodiment of the present invention.

Another discrete embodiment of the present invention is designated as 1200 in FIG. 14. The apparatus 1200 has a frame 1210 which includes an I-shaped base 1212; a forward stanchion or upright 1215 which extends upward from the base 1212 proximate a first end 1213 thereof; and a rearward stanchion or upright 1216 which extends upward from the base 1212 proximate a second, opposite end 1214 thereof.

Left and right flywheels 1220 are rotatably mounted on opposite sides of the rearward stanchion 1216 and rotate together about a common crank axis. Those skilled in the art will recognize that the flywheels 1220 may be connected to a conventional resistance device or replaced by some other rotating member(s) which may or may not, in turn, be connected to one or more flywheels and/or a conventional resistance device.

Left and right pins 1227 extend axially outward from diametrically opposed locations on respective cranks 1220 and define a crank diameter therebetween. Left and right rollers 1223 are rotatably mounted on respective pins 1227 and rollably support respective left and right rails 1230. The rails 1230 have opposite, forward ends which are rotatably connected to a common bracket 1240 mounted on the forward stanchion 1215. A fastener 1249 cooperates with a hole in the bracket 1240 and multiple holes 1219 in the stanchion 1215 to selectively adjust the bracket 1240 relative to the stanchion 1215 and thereby alter the inclination of exercise motion.

Left and right foot skates 1250 are movably mounted on intermediate portions of respective rails 1230. Each foot skate 1250 is sized and configured to support a respective foot of a standing person. Left and right drawbar links 1260 are rotatably interconnected between respective skates 1250 and respective rocker links 1270. The rocker links 1270 are rotatably connected to the base 1212 at rocker link axes 1272 disposed generally beneath the crank axis. The crank pins 1227 protrude into and travel along slots 1273 provided in respective rocker links 1270.

The resulting linkage assembly links rotation of the cranks 1220 to movement of the foot skates 1250 through generally elliptical paths designated as P14 in FIG. 14. The foot skates 1250 move vertically together with their respective rails 1230 and horizontally independent of their respective rails 1230. The range of horizontal motion is greater than the crank diameter defined between the crank pins 1227. The configuration of the paths P14 may be adjusted simply by moving the drawbar pivot joints along the respective rocker links 1270 (as suggested by holes 1276).

Figure 15:
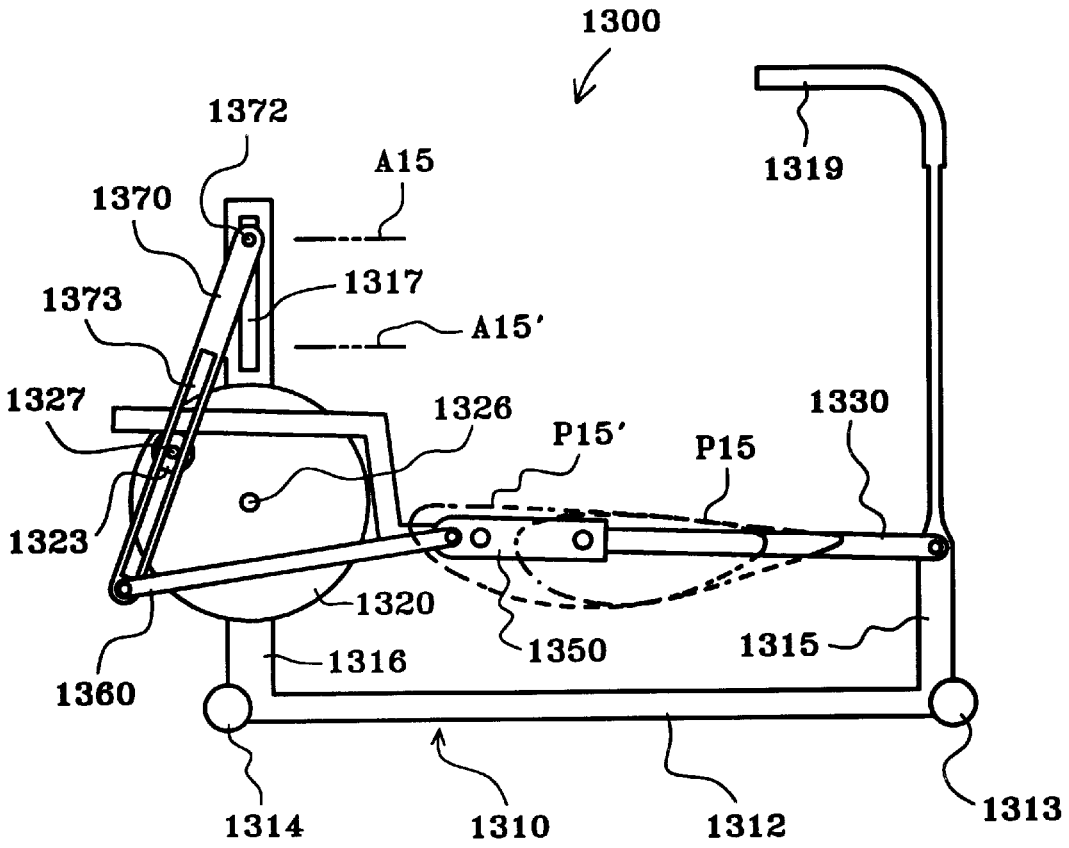
FIG. 15 is a side view of another embodiment of the present invention.

Another discrete embodiment of the present invention is designated as 1300 in FIG. 15. The apparatus 1300 has a frame 1310 which includes an I-shaped base 1312; a forward stanchion or upright 1315 which extends upward from the base 1312 proximate a first end 1313 thereof; and a rearward stanchion or upright 1316 which extends upward from the base 1312 proximate a second, opposite end 1314 thereof. Left and right handle bars 1319 are mounted on the upper end of the forward stanchion 1315.

Left and right flywheels 1320 are rotatably mounted on opposite sides of the rearward stanchion 1316 and rotate together about a common crank axis 1326. Left and right pins 1327 extend axially outward from diametrically opposed locations on respective flywheels or cranks 1320 and define a crank diameter therebetween. Left and right rollers 1323 are rotatably mounted on respective pins 1327 and rollably support respective left and right rails 1330. The rails 1330 have opposite, forward ends which are rotatably connected to the forward stanchion 1315.

Left and right foot skates 1350 are movably mounted (by means known in the art) on intermediate portions of respective rails 1330. Each foot skate 1350 is sized and configured to support a respective foot of a standing person. Left and right drawbar links 1360 are rotatably interconnected between respective skates 1350 and respective rocker links 1370. The rocker links 1370 are rotatably connected to the rearward stanchion 1316 at rocker link axes 1372 disposed generally above the crank axis. The crank pins 1327 protrude into and travel along slots 1373 provided in respective rocker links 1370.

When the rocker axes 1327 occupy the position aligned with reference line A15, the linkage assembly links rotation of the cranks 1320 to movement of the foot skates 1350 through generally elliptical paths designated as P15 in FIG. 15. The foot skates 1350 move vertically together with their respective rails 1330 and horizontally independent of their respective rails 1330.

A slot 1317 is provided in the rearward stanchion 1316 to facilitate movement of the rocker pivots 1372 relative thereto. A single adjustment member (of any suitable type known in the art) is interconnected between the stanchion 1316 and the rocker pivots 1372 and operable to selectively move the latter relative to the former. When the rocker axes 1327 occupy the position aligned with reference line A15', the linkage assembly links rotation of the cranks 1320 to movement of the foot skates 1350 through generally elliptical paths designated as P15'. In this configuration, the range of horizontal motion is greater than the crank diameter defined between the crank pins 1327.

Figure 16:
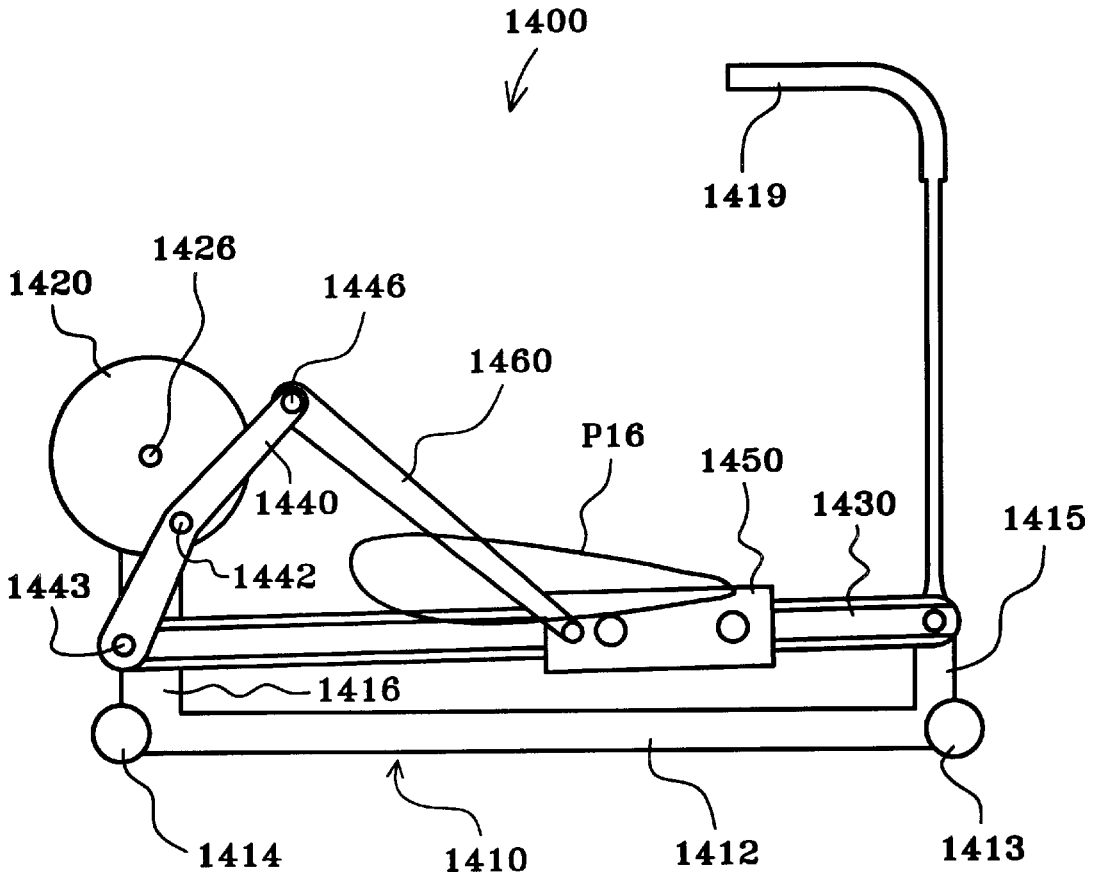
FIG. 16 is a side view of another embodiment of the present invention.

Another discrete embodiment of the present invention is designated as 1400 in FIG. 16. The apparatus 1400 has a frame 1410 which includes an I-shaped base 1412; a forward stanchion or upright 1415 which extends upward from the base 1412 proximate a first end 1413 thereof; and a rearward stanchion or upright 1416 which extends upward from the base 1412 proximate a second, opposite end 1414 thereof. Left and right handle bars 1419 are mounted on the upper end of the forward stanchion 1415.

Left and right flywheels 1420 are rotatably mounted on opposite sides of the rearward stanchion 1416 and rotate together about a common crank axis 1426. Left and right pins 1442 extend axially outward from diametrically opposed locations on respective flywheels or cranks 1420 and define a crank diameter therebetween. Left and right connector links 1440 have intermediate portions which are rotatably connected to respective cranks 1420 by means of respective crank pins 1442. The connector links 1440 have first ends which are rotatably connected to rearward ends of respective rails 1430 (at respective pivot joints 1443), and second, opposite ends which are rotatably connected to respective drawbar links 1460 (at respective pivot joints 1446). Forward ends of the left and right rails 1430 are rotatably connected to opposite sides of the forward stanchion 1415.

Left and right foot skates 1450 are movably mounted (by means known in the art) on intermediate portions of respective rails 1430. Each foot skate 1450 is sized and configured to support a respective foot of a standing person. The foot skates 1450 are rotatably connected to ends of respective drawbar links 1460 opposite the pivot joints 1446. The resulting linkage assembly links rotation of the cranks 1420 to movement of the foot skates 1450 through generally elliptical paths designated as P16 in FIG. 16. The foot skates 1450 are constrained to move vertically together with their respective rails 1430 but are free to move horizontally independent of their respective rails 1430. The range of horizontal motion is greater than the crank diameter defined between the crank pins 1442.

Figure 17:
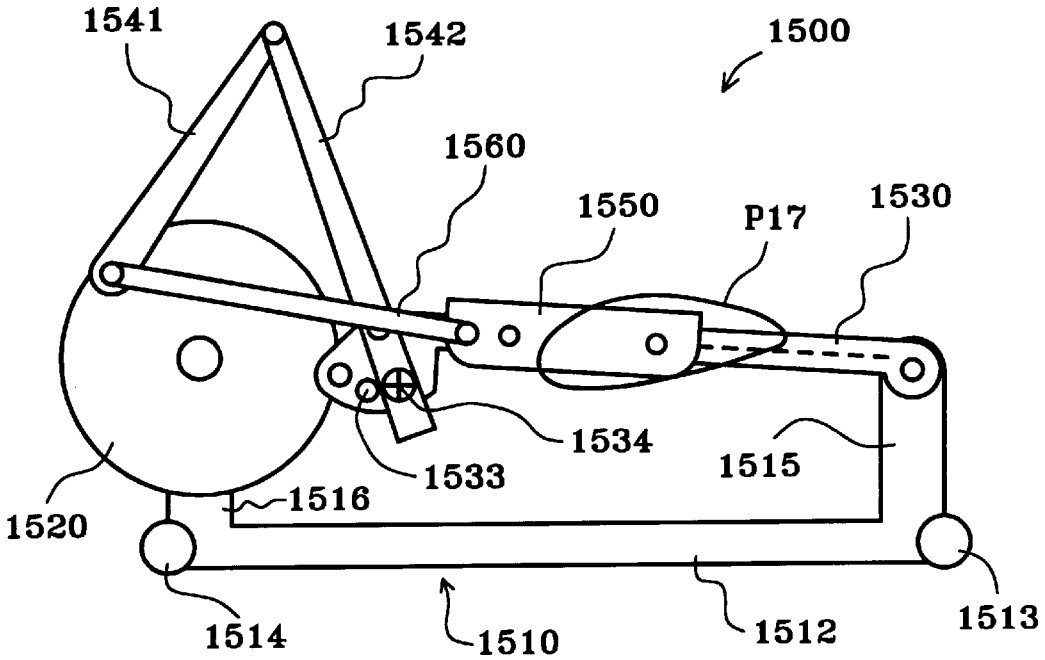
FIG. 17 is a side view of another embodiment of the present invention.
Figure 18:
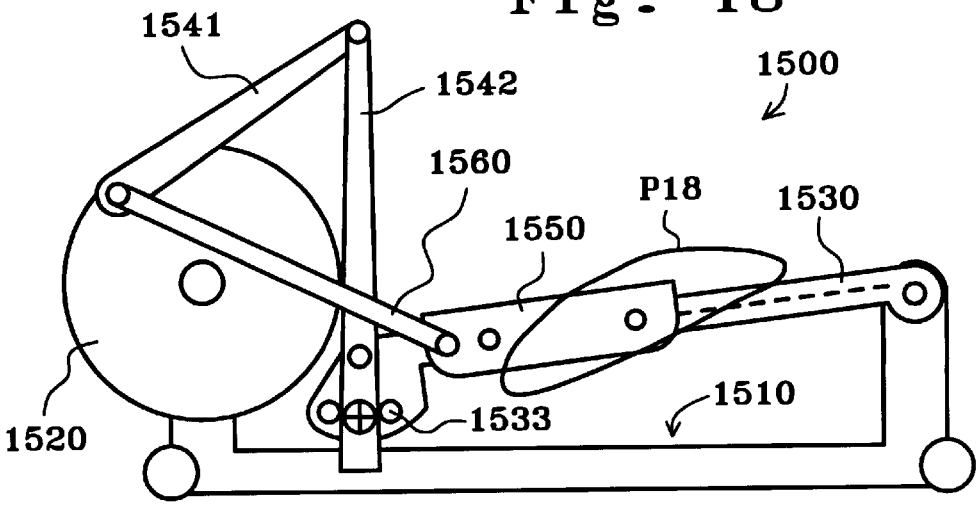
FIG. 18 is a side view of the embodiment of FIG. 17 configured in a discrete manner.

Another discrete embodiment of the present invention is designated as 1500 in FIGS. 17–18. The apparatus 1500 has a frame 1510 which includes an I-shaped base 1512; a forward stanchion or upright 1515 which extends upward from the base 1512 proximate a first end 1513 thereof; and a rearward stanchion or upright 1516 which extends upward from the base 1512 proximate a second, opposite end 1514 thereof.

Left and right flywheels 1520 are rotatably mounted on opposite sides of the rearward stanchion 1516 and rotate together about a common crank axis. Left and right pins extend axially outward from diametrically opposed locations on respective flywheels (or cranks) 1520 and define a crank diameter therebetween. First links 1541 are rotatably interconnected between respective crank pins and upper ends of respective second links 1542. Opposite, lower ends of the second links 1542 are secured to first ends of respective rails 1530. More specifically, lower portions of the second links 1542 are rotatably connected to respective rails 1530, and lower ends of the second links 1542 are releasably connected to respective rails 1530. Holes 1533 are arranged in arcs about respective pivot joints defined between respective rails 1530 and second links 1542, and fasteners 1534 insert through selectively aligned holes 1533 to rigidly secure the respective linkage assembly components together.

Opposite, second ends of the left and right rails 1530 are rotatably connected to opposite sides of the forward stanchion 1515. Left and right foot skates 1550 are movably mounted on intermediate portions of respective rails 1530. Each foot skate 1550 is sized and configured to support a respective foot of a standing person. Left and right drawbar links 1560 are rotatably interconnected between respective foot skates 1550 and respective cranks 1520. The drawbar links 1560 and the first links 1541 are connected to the same crank pins for purposes of manufacturing efficiency rather than operational necessity.

When the second links 1542 occupy the orientation relative to the rails 1530 shown in FIG. 17, the linkage assembly links rotation of the cranks 1520 to movement of the foot skates 1550 through generally elliptical paths designated as P17 in FIG. 17. The foot skates 1550 move vertically together with their respective rails 1530 and horizontally independent of their respective rails 1530. When the second links 1542 occupy the orientation relative to the rails 1530 shown in FIG. 18, the linkage assembly links rotation of the cranks 1520 to movement of the foot skates 1550 through generally elliptical paths designated as P18. In this configuration, the stride length is greater than the crank diameter defined between the crank pins, and the resulting motion is relatively more uphill.

Figure 19:
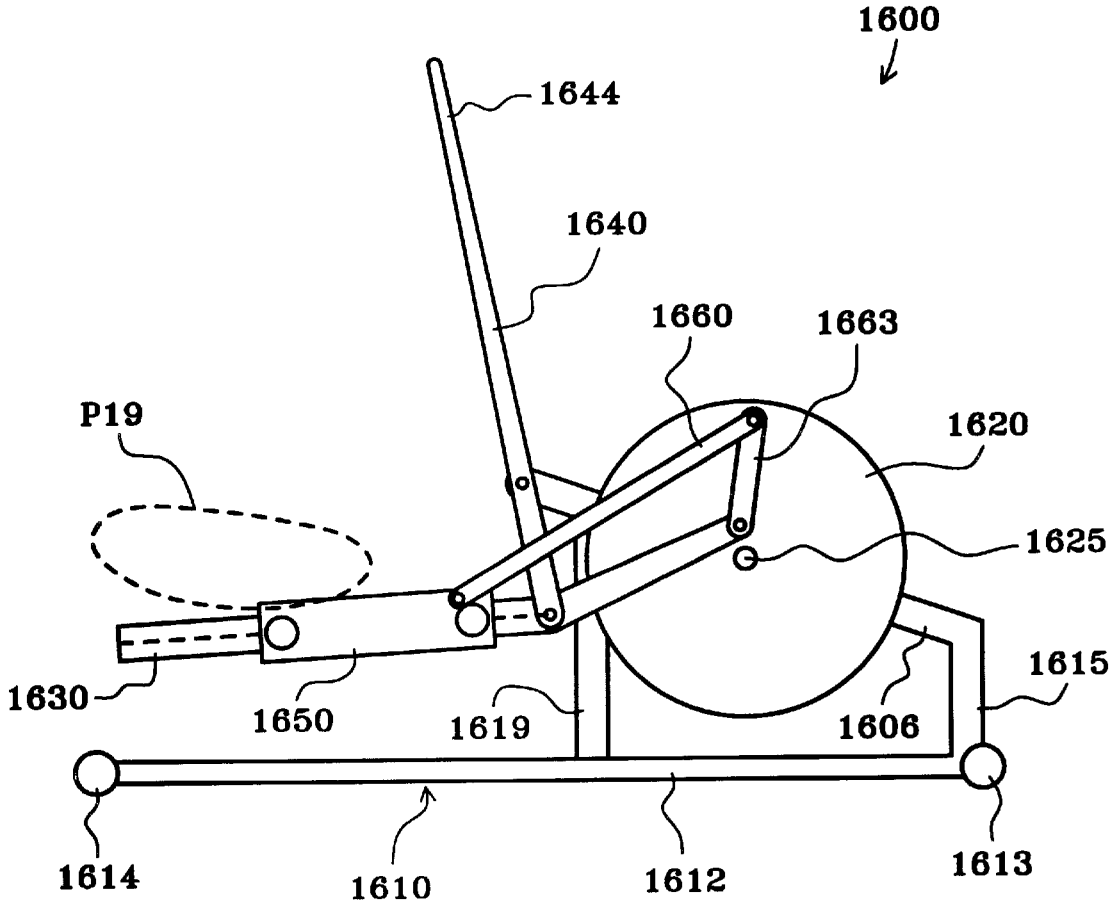
FIG. 19 is a side view of yet another embodiment of the present invention.

Another discrete embodiment of the present invention is designated as 1600 in FIG. 19. The apparatus 1600 has a frame 1610 which includes an I-shaped base 1612; a forward stanchion or upright 1615 which extends upward from the base 1612 proximate a first end 1613 thereof; an intermediate stanchion or upright 1619 which extends upward from the base 1612 between the first end 1613 and a second, opposite end 1614 thereof; and a beam 1606 rigidly mounted on the upper ends of the stanchions 1615 and 1619.

Left and right flywheels 1620 are rotatably mounted on opposite sides of the beam 1606 and rotate together about a common crank axis 1625. Left and right rails 1630 have first ends which are rotatably connected to respective cranks 1620 and cooperate therewith to define first crank radii. The rails 1630 have intermediate portions which are rotatably connected to lower ends of respective rocker links 1640. Intermediate portions of the rocker links 1640 are rotatably mounted on opposite sides of the beam 1606, and upper ends of the rocker links 1640 are sized and configured for grasping.

Left and right foot skates 1650 are movably mounted (by means known in the art) on second, opposite ends of respective rails 1630. Each foot skate 1650 is sized and configured to support a respective foot of a standing person. Left and right drawbar links 1660 are rotatably interconnected between respective foot skates 1650 and respective cranks 1620 and cooperate with the latter to define second, relatively greater crank radii. Left and right links 1663 are rigidly secured to respective cranks 1620 at respective first crank radii, and are rotatably secured to respective drawbar links 1660 at respective second crank radii. The links 1663 are arranged in such a manner that the first and second crank radii are approximately radially aligned with one another. The resulting linkage assembly constrains the foot skates 1650 to move vertically together with their respective rails 1630 and allows the foot skates 1650 to move horizontally independent of their respective rails 1630. Rotation of the cranks 1620 causes the foot skates 1650 to move through generally elliptical paths designated as P19 in FIG. 19.

Figure 20:
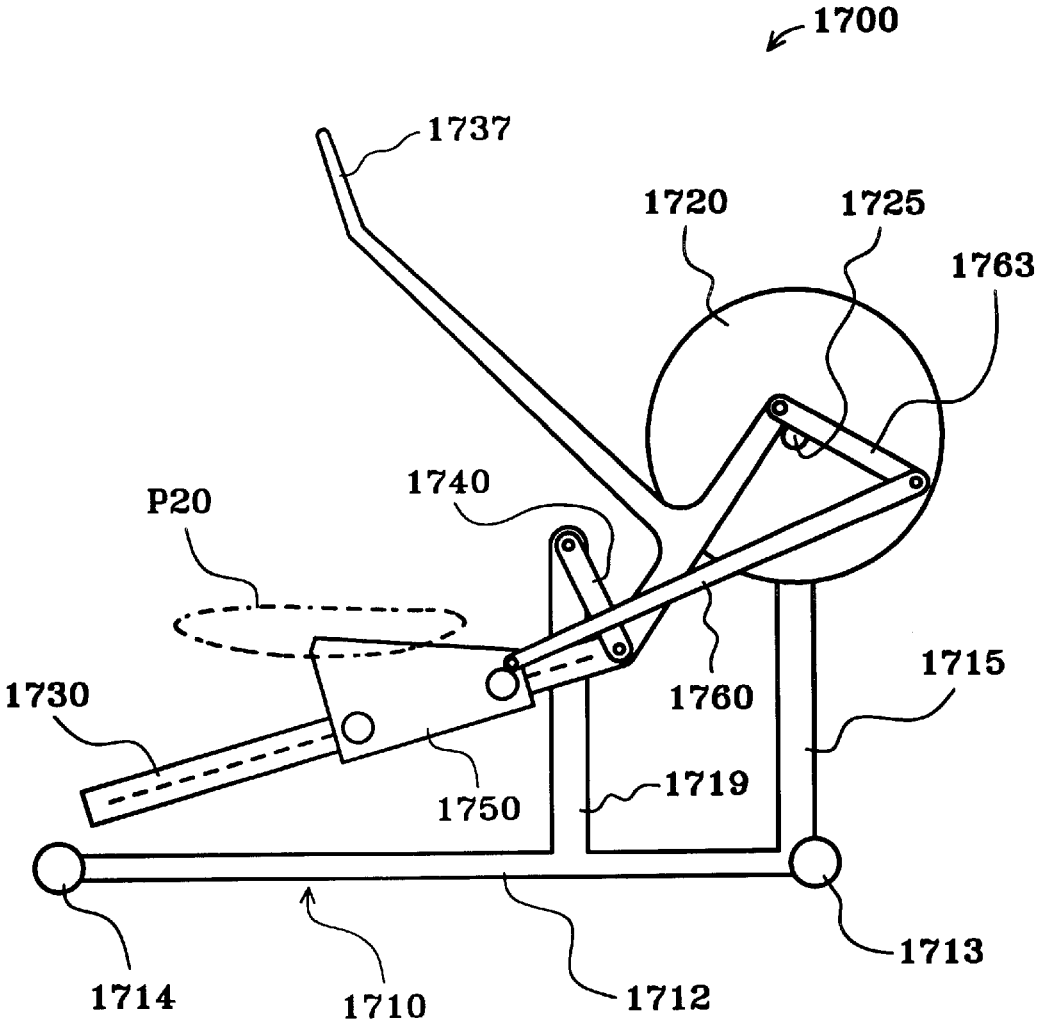
FIG. 20 is a side view of still another embodiment of the present invention.

Another discrete embodiment of the present invention is designated as 1700 in FIG. 20. The apparatus 1700 has a frame 1710 which includes an I-shaped base 1712; a forward stanchion or upright 1715 which extends upward from the base 1712 proximate a first end 1713 thereof; and an intermediate stanchion or upright 1719 which extends upward from the base 1712 between the first end 1713 and a second, opposite end 1714 thereof.

Left and right flywheels 1720 are rotatably mounted on opposite sides of the stanchion 1715 and rotate together about a common crank axis 1725. Left and right rails 1730 have first ends which are rotatably connected to respective cranks 1720 and cooperate therewith to define first crank radii. The rails 1730 have intermediate portions which are rotatably connected to lower ends of respective rocker links 1740. Opposite, upper ends of the rocker links 1740 are rotatably connected to opposite sides of the intermediate stanchion 1719. Left and right handle members 1737 are rigidly secured to respective rails 1730 between the connection points with the rocker links 1740 and the cranks 1720.

Left and right foot skates 1750 are movably mounted on second, opposite ends of respective rails 1730. Each foot skate 1750 is sized and configured to support a respective foot of a standing person. Left and right drawbar links 1760 are rotatably interconnected between respective foot skates 1750 and respective cranks 1720 and cooperate with the latter to define second, relatively greater crank radii. Left and right links 1763 are rigidly secured to respective cranks 1720 at respective first crank radii, and are rotatably secured to respective drawbar links 1760 at respective second crank radii. The links 1763 are arranged in such a manner that the first and second crank radii are approximately diametrically aligned with one another. The resulting linkage assembly constrains the foot skates 1750 to move vertically together with their respective rails 1730 and allows the foot skates 1750 to move horizontally independent of their respective rails 1730. Rotation of the cranks 1720 causes the foot skates 1750 to move through generally elliptical paths designated as P20 in FIG. 20.

To the extent that any references have been made to "forward" or "rearward" components or assemblies, such terminology is merely for discussion purposes and thus, should not be construed as a limitation regarding how a machine or linkage assembly may be used or which direction a user must face. Also, the fact that the present invention has been described with reference to particular embodiments and applications does not mean that it should be limited in that regard. The foregoing description will enable those skilled in the art to recognize additional embodiments, modifications, and/or applications which fall within the scope of the present invention. For example, the various elevation adjustment mechanisms and/or arm exercise arrangements may be mixed and matched with many of the foregoing embodiments; any of various known inertia altering devices (i.e. a motor, a "stepped up" flywheel, and/or an adjustable brake of some sort) may be provided; and/or the rotationally interconnected components may be modified so that an end of a first linkage component is nested between opposing prongs on the end of a second linkage component. Recognizing that the foregoing description sets forth only some of the numerous possible modifications and variations, the scope of the present invention is to be limited only to the extent of the claims which follow.

What is claimed is:

1. An exercise apparatus, comprising:

a frame designed to rest upon a floor surface;

left and right cranks rotatably mounted on said frame;

left and right rails having first ends supported by respective cranks and second ends supported by said frame; and left and right foot supports movably mounted on respective rails and connected to respective cranks in such a manner that rotation of said cranks causes each of said foot supports to move vertically together with a respective rail and horizontally relative to a respective rail.

2. The exercise apparatus of claim 1, wherein left and right rollers are rotatably mounted on respective cranks and disposed beneath respective first ends.

3. The exercise apparatus of claim 2, wherein said second ends are pivotally connected to said frame so that said first ends are constrained to pivot up and down during rotation of said cranks.

4. The exercise apparatus of claim 1, wherein said second ends are supported by respective rollers rotatably mounted on said frame.

5. The exercise apparatus of claim 1, wherein said foot supports are constrained to remain parallel to respective rails during rotation of said cranks.

6. The exercise apparatus of claim 1, wherein said cranks rotate about a common crank axis relative to said frame, and said second ends are pivotally connected to said frame at a common pivot axis which extends parallel to said crank axis.

7. The exercise apparatus of claim 6, wherein said first ends are supported by respective rollers rotatably mounted on respective cranks.

8. The exercise apparatus of claim 7, wherein left and right rocker links have (a) first ends pivotally connected to said frame proximate respective cranks; (b) opposite, second ends linked to respective foot supports; and (c) intermediate portions operatively connected to respective rollers so that said rocker links pivot back and forth during rotation of said cranks.

9. The exercise apparatus of claim 8, wherein left and right drawbars are pivotally interconnected between respective rocker links and respective foot supports.

10. The exercise apparatus of claim 9, wherein said drawbars and said rocker links cooperate to define respective pivot axes which are selectively movable along respective rocker links.

11. A method of linking rotation of left and right cranks to generally elliptical motion of left and right foot supporting members, comprising the steps of:

providing a frame sized and configured to support a person relative to an underlying floor surface;

rotatably mounting the left and right cranks on the frame;

movably interconnecting left and right rails between the frame and respective cranks; and movably mounting left and right foot supports on respective rails and connecting the foot supports to respective cranks in such a manner that rotation of the cranks causes each of the foot supports to move vertically together with a respective rail and horizontally relative to a respective rail.

12. The method of claim 11, wherein left and right rollers are rotatably mounted on respective cranks and disposed beneath respective rails.

13. The method of claim 12, wherein the rails are pivotally connected to the frame.

14. The method of claim 11, wherein left and right rollers are rotatably mounted on the frame and disposed beneath respective rails.

15. The method of claim 11, wherein the foot supports are constrained to remain parallel to respective rails.

16. The method of claim 11, wherein the cranks rotate about a common crank axis relative to the frame, and the rails are pivotally connected to the frame at a pivot axis which extends parallel to the crank axis.

17. The method of claim 16, wherein the rails are supported by respective rollers rotatably mounted on respective cranks.

18. The method of claim 17, wherein the foot supports are connected to respective cranks by providing left and right rocker links and (a) pivotally connecting first ends of the rocker links to the frame proximate respective cranks; (b) linking opposite, second ends of the rocker links to respective foot supports; and (c) connecting intermediate portions of the rocker links to respective rollers so that the rocker links pivot back and forth during rotation of the cranks.

19. The method of claim 18, wherein the linking step involves pivotally interconnecting left and right drawbars between respective rocker links and respective foot supports.

20. The method of claim 19, wherein the drawbars and the rocker links cooperate to define respective pivot axes, and further comprising the step of selectively moving the pivot axes along respective rocker links.

* * * * *